US006298867B1

(12) United States Patent
Chang

(10) Patent No.: US 6,298,867 B1
(45) Date of Patent: Oct. 9, 2001

(54) HUB AND RIB ASSEMBLY FOR UMBRELLA

(76) Inventor: John Chang, 5-4FL., No. 43, Lane 174, Sec. 3, Cheng Kung Rd., Taipei (TW)

( * ) Notice: Subject to any disclaimer, the term of this patent is extended or adjusted under 35 U.S.C. 154(b) by 0 days.

(21) Appl. No.: 09/505,864

(22) Filed: Feb. 17, 2000

(51) Int. Cl.[7] ..... A45B 25/06

(52) U.S. Cl. ..... 135/28; 135/31; 135/37; 135/38; 135/41

(58) Field of Search ..... 135/15, 1, 28–29, 135/30, 31–32, 37, 38, 41

(56) References Cited

U.S. PATENT DOCUMENTS 4,407,317 * 10/1983 Crandall ..... 135/27
5,738,129 * 4/1998 Vogt ..... 135/28
5,794,637 * 8/1998 Figueroa ..... 135/27
5,911,233 * 6/1999 Wu ..... 135/28
5,941,261 * 8/1999 Kouvaras ..... 135/27
6,076,540 * 6/2000 You ..... 135/28

* cited by examiner

*Primary Examiner*—Beth A. Stephan
(74) *Attorney, Agent, or Firm*—Rosenberg, Klein & Lee

(57) ABSTRACT

A hub and rib assembly for umbrella comprises a hub and a plurality of ribs, all made of ductile material. Each rib has an end integrally formed and connected with the hub, whereby assembling thereof is easy and not involved other tools. In other word, the cost is reduced and the safety is enhanced.

12 Claims, 12 Drawing Sheets

HUB AND RIB ASSEMBLY FOR UMBRELLA

FIELD OF THE INVENTION

The present invention relates to a hub and rib assembly for umbrella, by which the cost is reduced and the safety is enhanced.

BACKGROUND OF THE INVENTION

As shown in FIG. 1, a conventional umbrella has a plurality of lower ribs 10*a* connected to a lower hub 11*a* movably arranged on a shank 12*a*. The lower hub 11*a* is moved upward and downward to expand or shrink the lower ribs 10*a*. Moreover, a plurality of upper ribs 14*a* are connected to an upper hub 13*a* movably arranged on top of the shank 12*a*. A handle 15*a* is provided on the bottom of the shank 12*a*.

As shown in FIG. 2, the conventional ribs 10*a* (14*a*) are assembled on the hub 11*a* (13*a*) by tying metal wire 16*a* through each rib. However, the tying operation is cumbersome and the sharp metal wire 16*a* is dangerous to user.

It is the object of the present invention to provide a rib and hub assembly for an umbrella, wherein the ribs and hub of the assembly are integrally formed by ductile materials. The assembling thereof is convenient and does not require other tools, whereby cost is reduced and safety is enhanced.

To achieve above object, the present invention provides a hub and rib assembly for umbrella, comprising a hub and a plurality of ribs, all made of ductile material. Each rib has an end integrally formed and connected with the hub.

The various objects and advantages of the present invention will be more readily understood from the following detailed description when read in conjunction with the appended drawing, in which:

DETAILED DESCRIPTION OF THE PREFERRED EMBODIMENT

Figure 1:
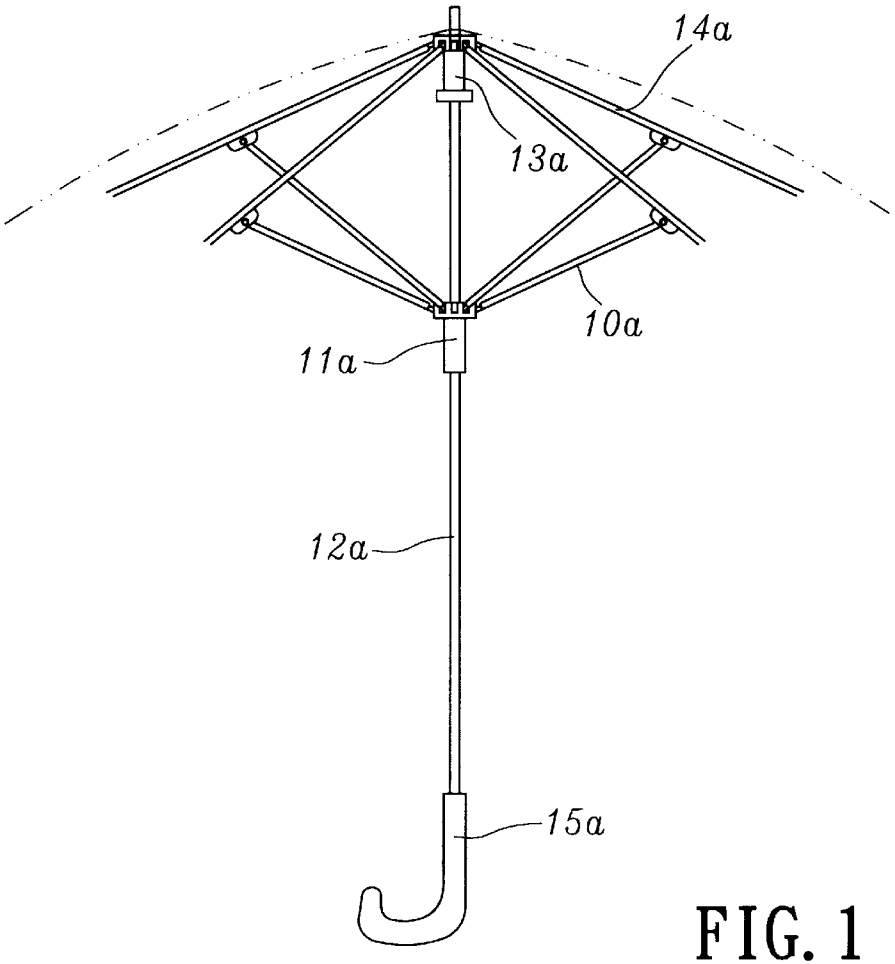
FIG. 1 PRIOR ART
FIG. 1 is a planar view of a prior art umbrella.
Figure 2A:
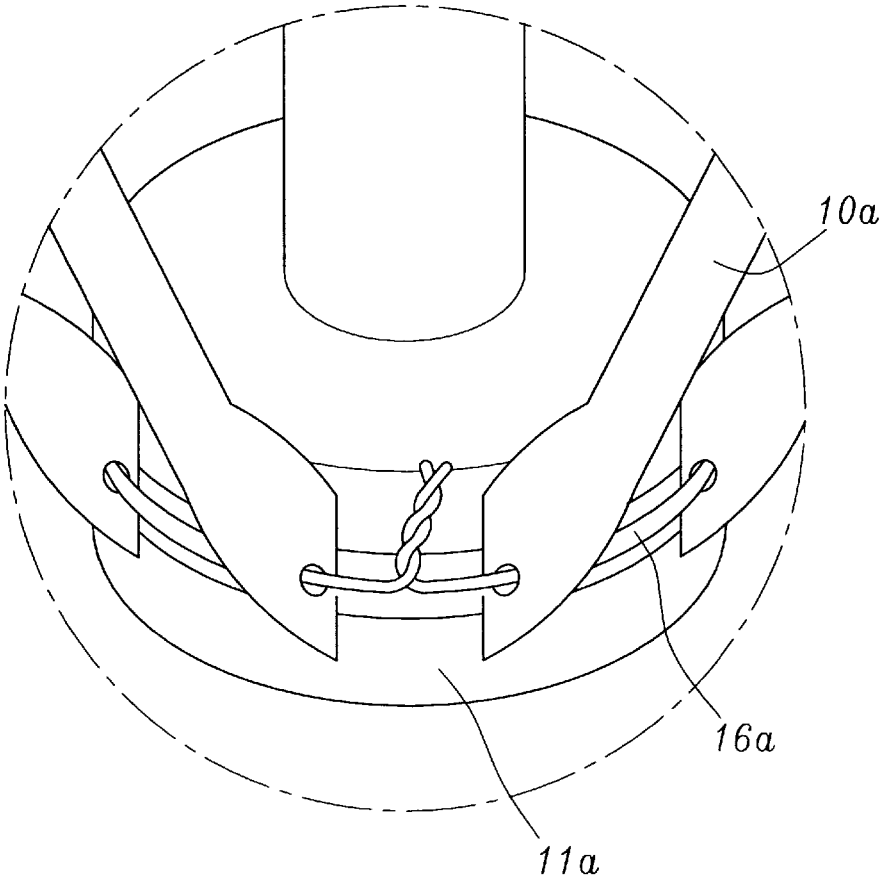
FIG. 2A PRIOR ART
FIG. 2A is an enlarged view of a portion of the view shown in FIG. 2.
Figure 2:
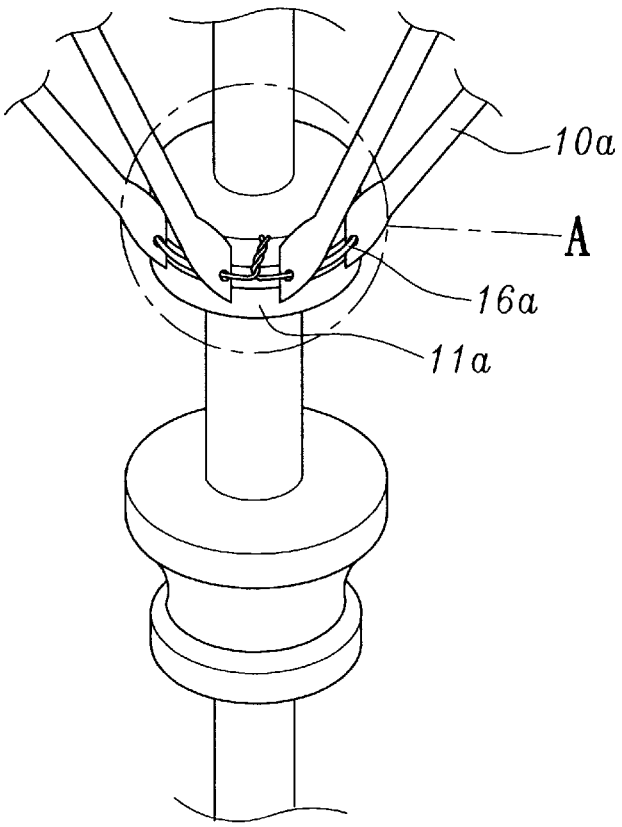
FIG. 2 PRIOR ART
FIG. 2 is a perspective view of a prior art umbrella.
Figure 3:
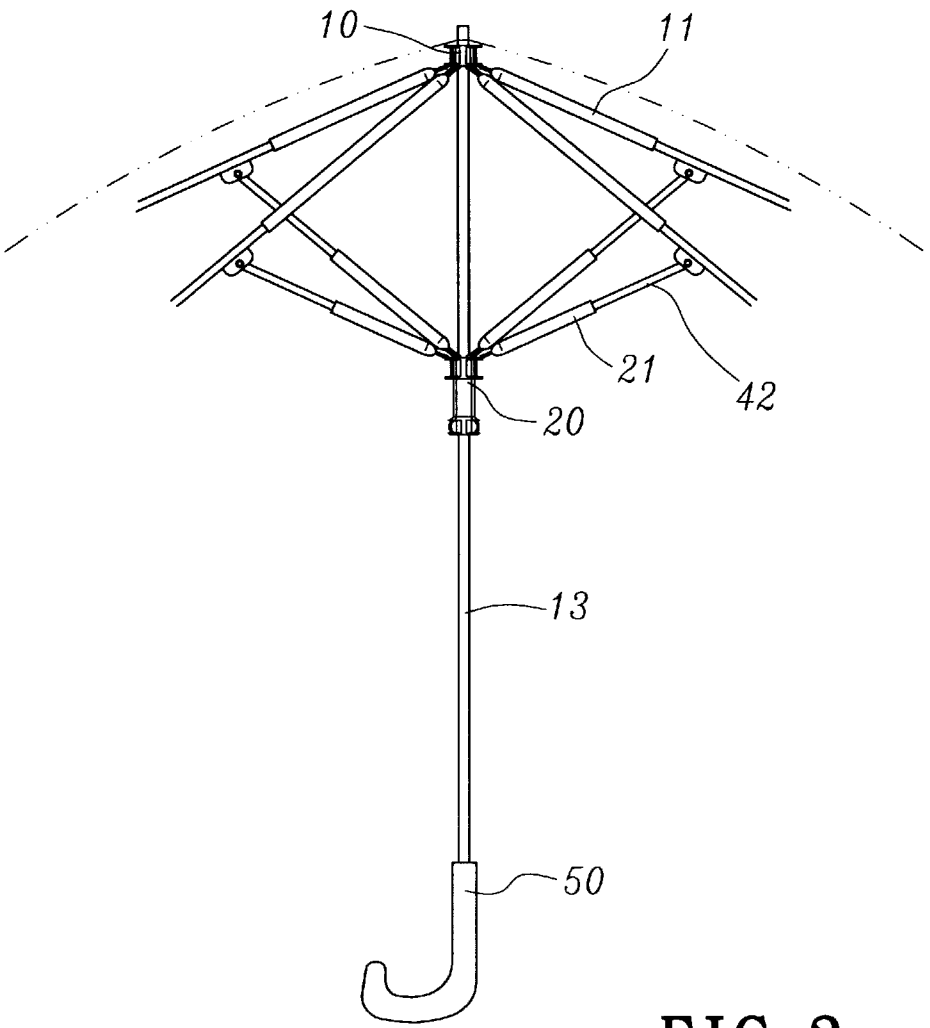
FIG. 3 is a planar view of an umbrella of the invention.
Figure 4:
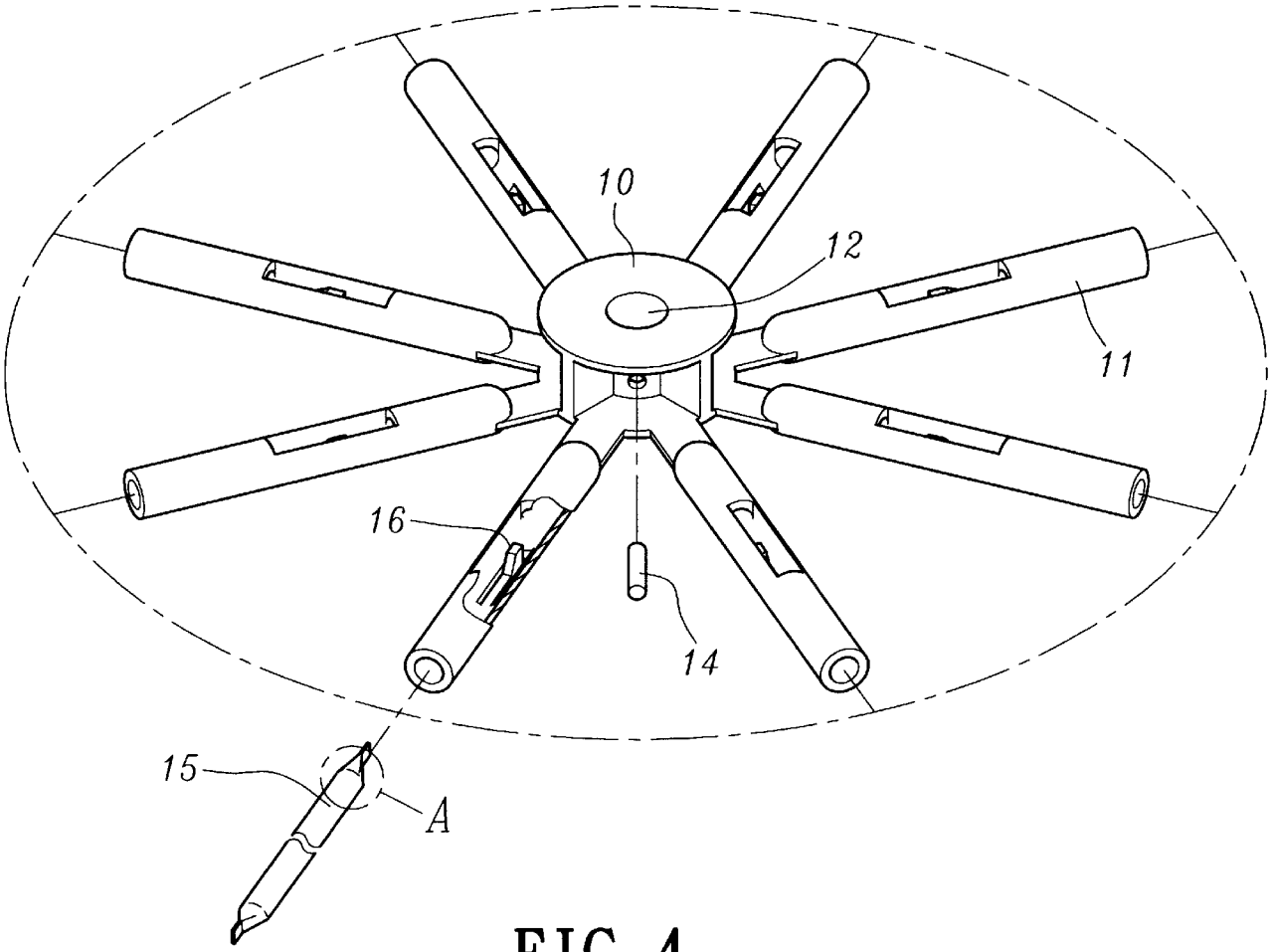
FIG. 4 is a perspective view of an umbrella according to a first preferred embodiment of the invention.
Figure 4A:
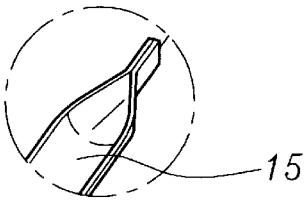
FIG. 4A is a partial perspective view of an umbrella according to the first preferred embodiment of the invention.
Figure 5:
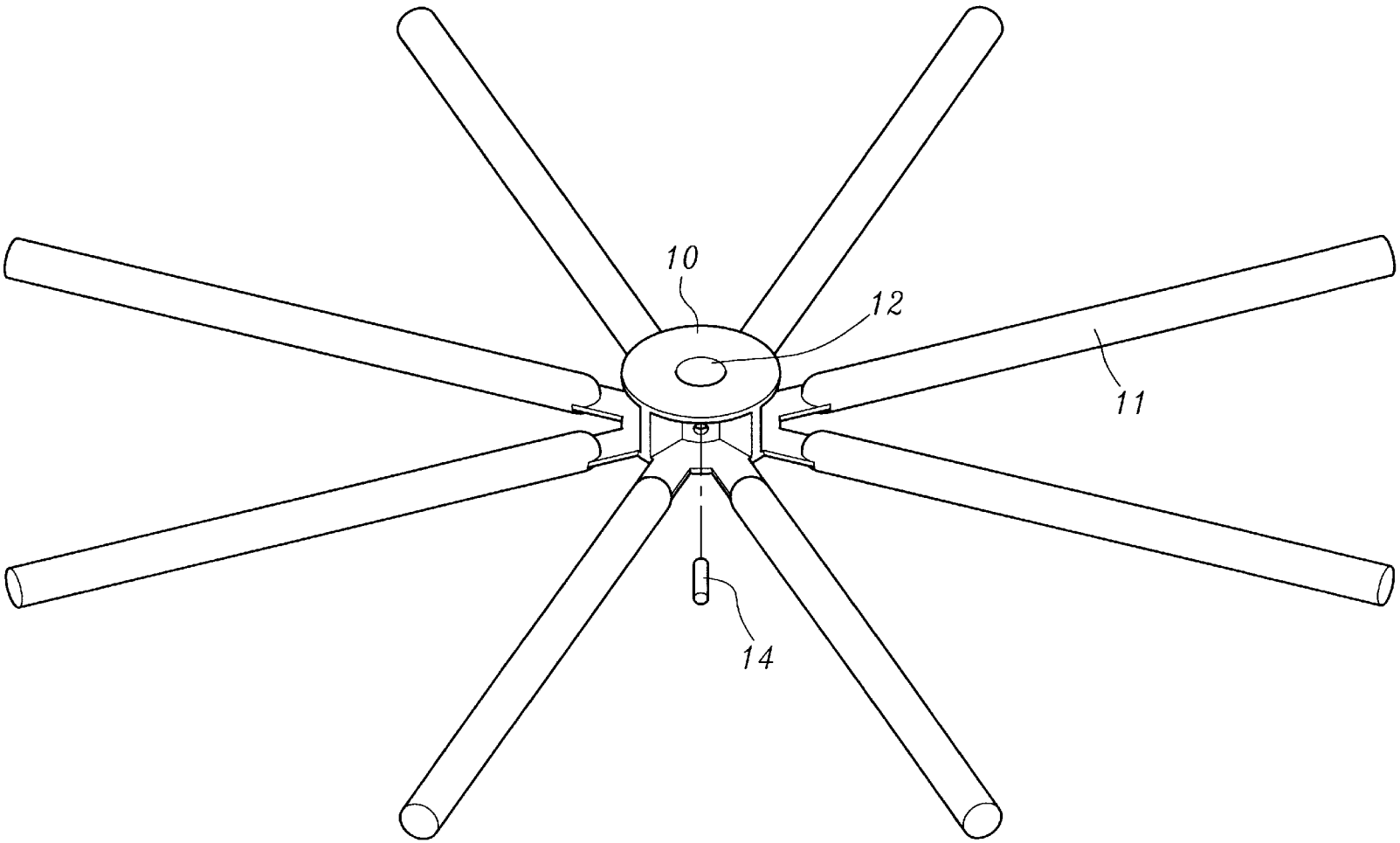
FIG. 5 is a perspective view of an umbrella according to a second preferred embodiment of the invention.
Figure 6:
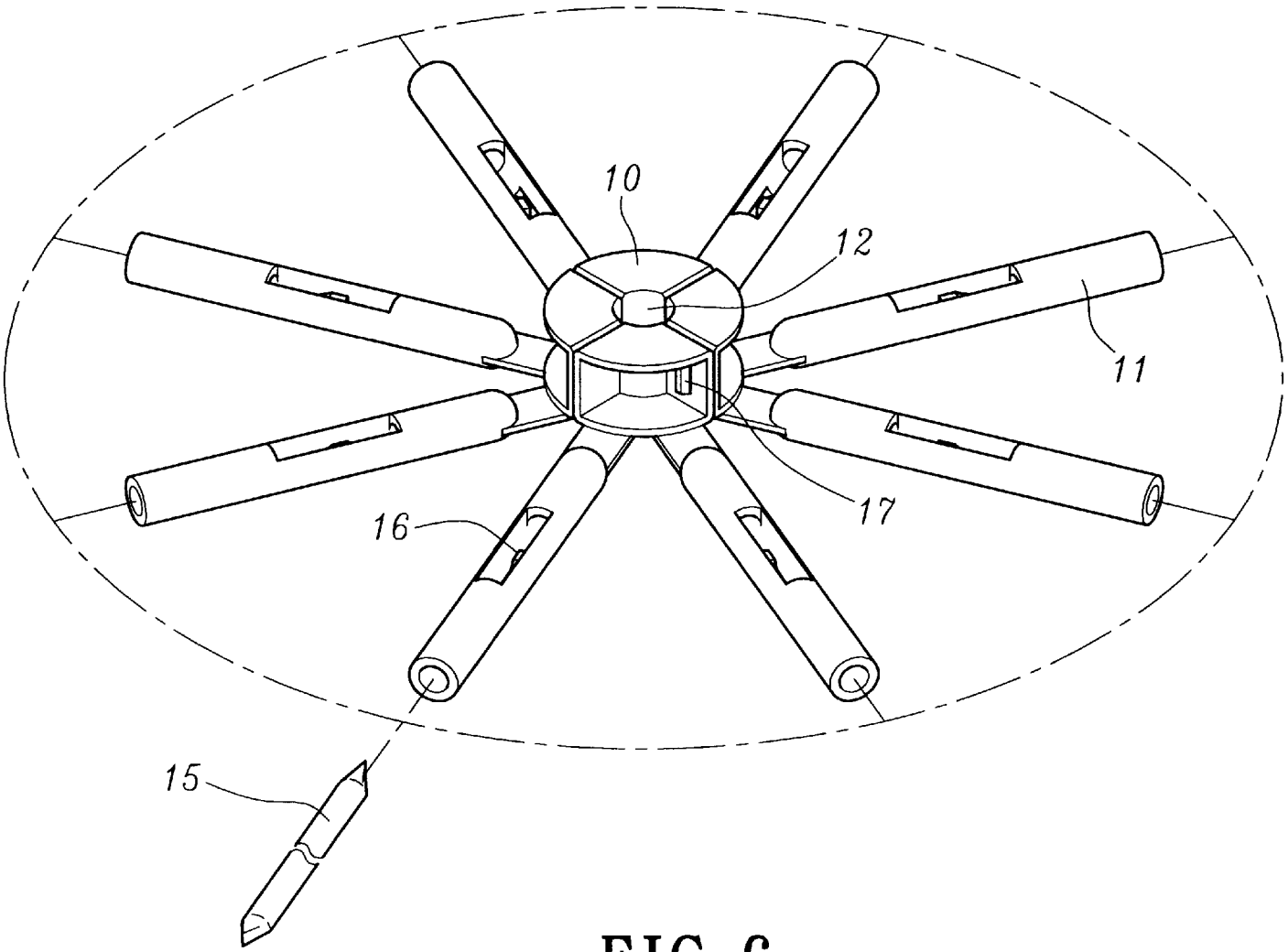
FIG. 6 is a perspective view of an umbrella according to a third preferred embodiment of the invention.
Figure 9:
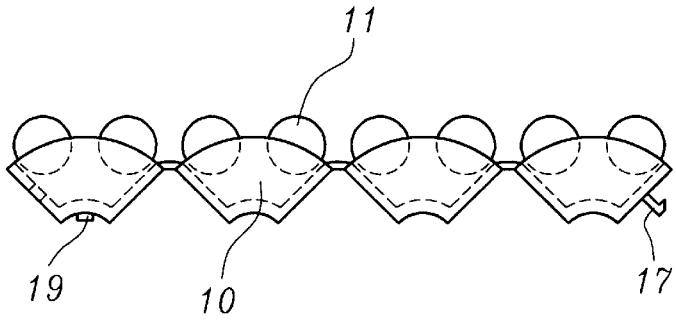
FIG. 9 is a top view of an umbrella according to the third preferred embodiment of the invention.
Figure 8:
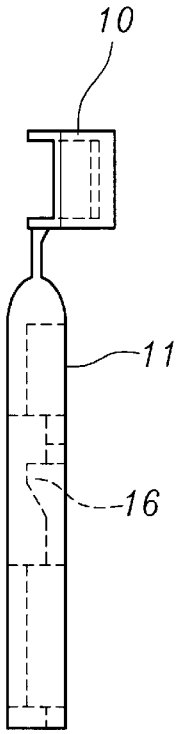
FIG. 8 is a side view of an umbrella according to the third preferred embodiment of the invention.
Figure 7:
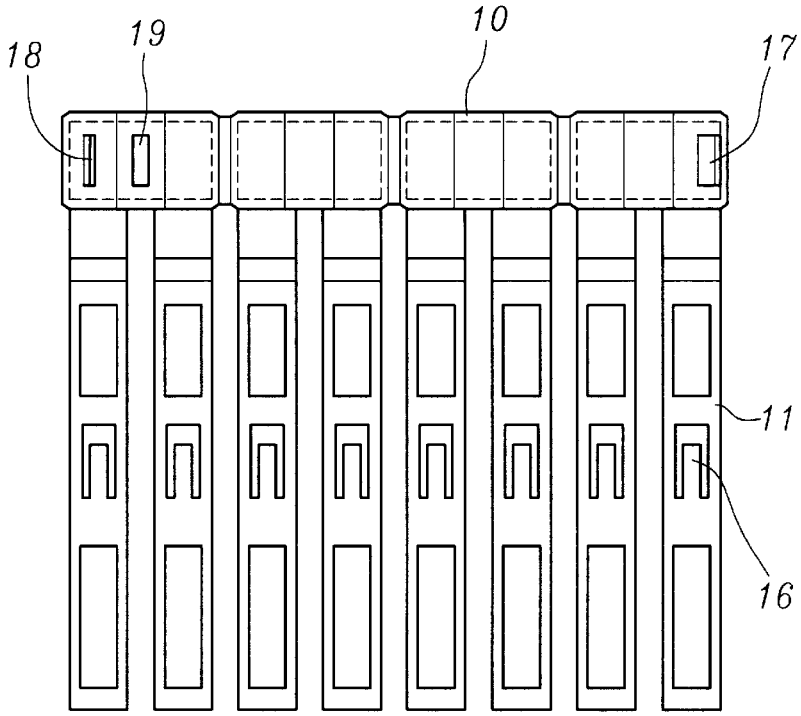
FIG. 7 is a front view of an umbrella according to the third preferred embodiment of the invention.
Figure 10:
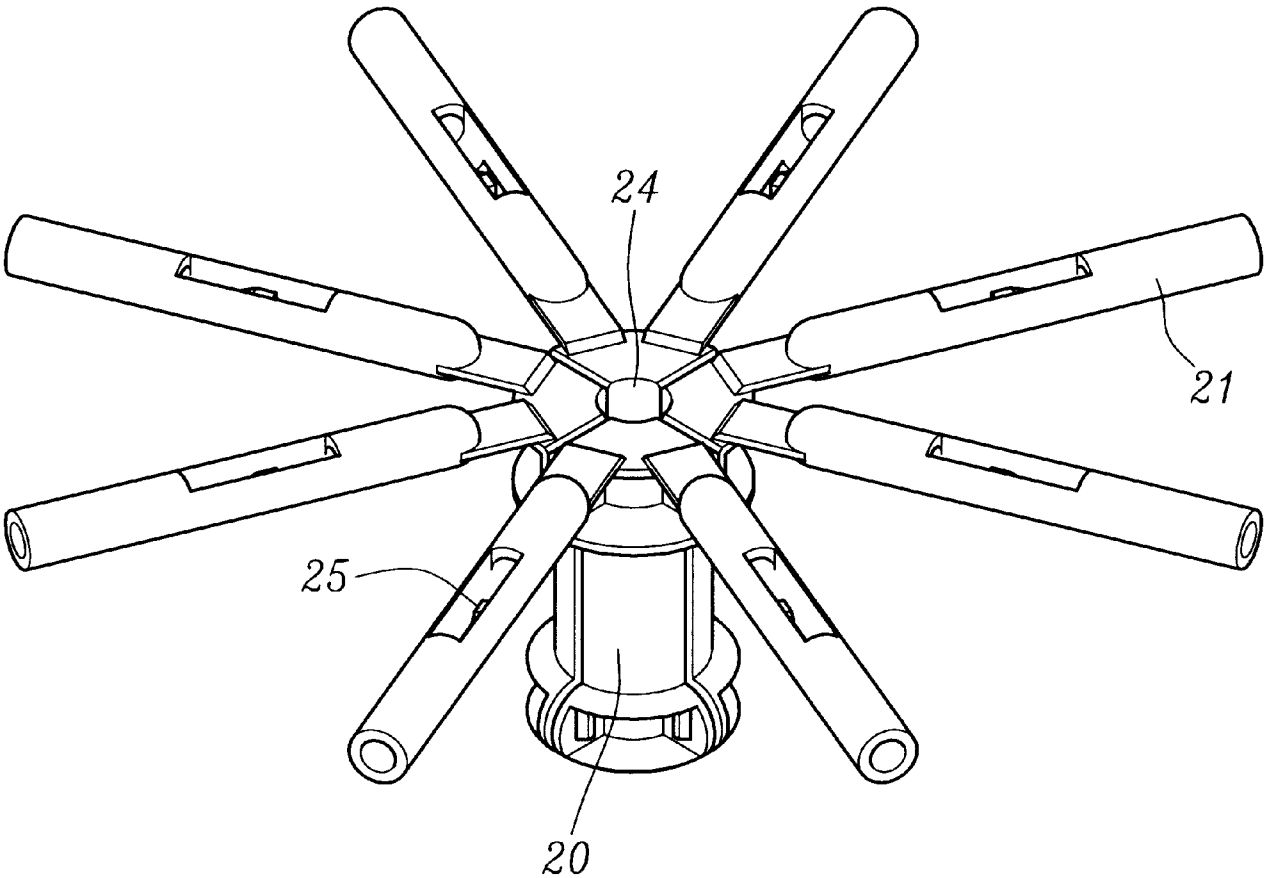
FIG. 10 is a perspective view of an umbrella according to a fourth preferred embodiment of the invention.
Figure 13:
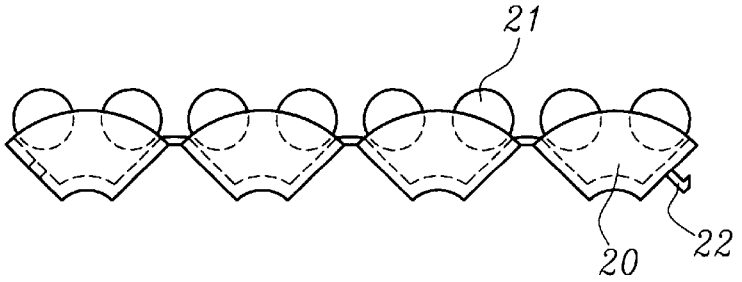
FIG. 13 is a top view of an umbrella according to the fourth preferred embodiment of the invention.
Figure 12:
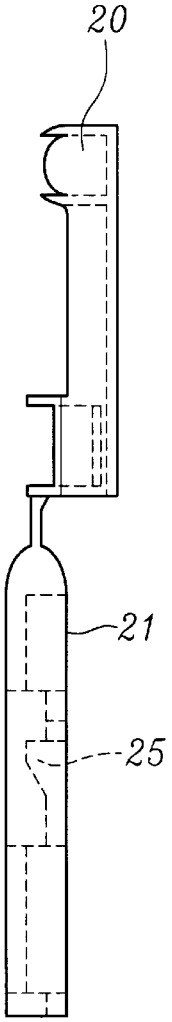
FIG. 12 is a side view of an umbrella according to the fourth preferred embodiment of the invention.
Figure 11:
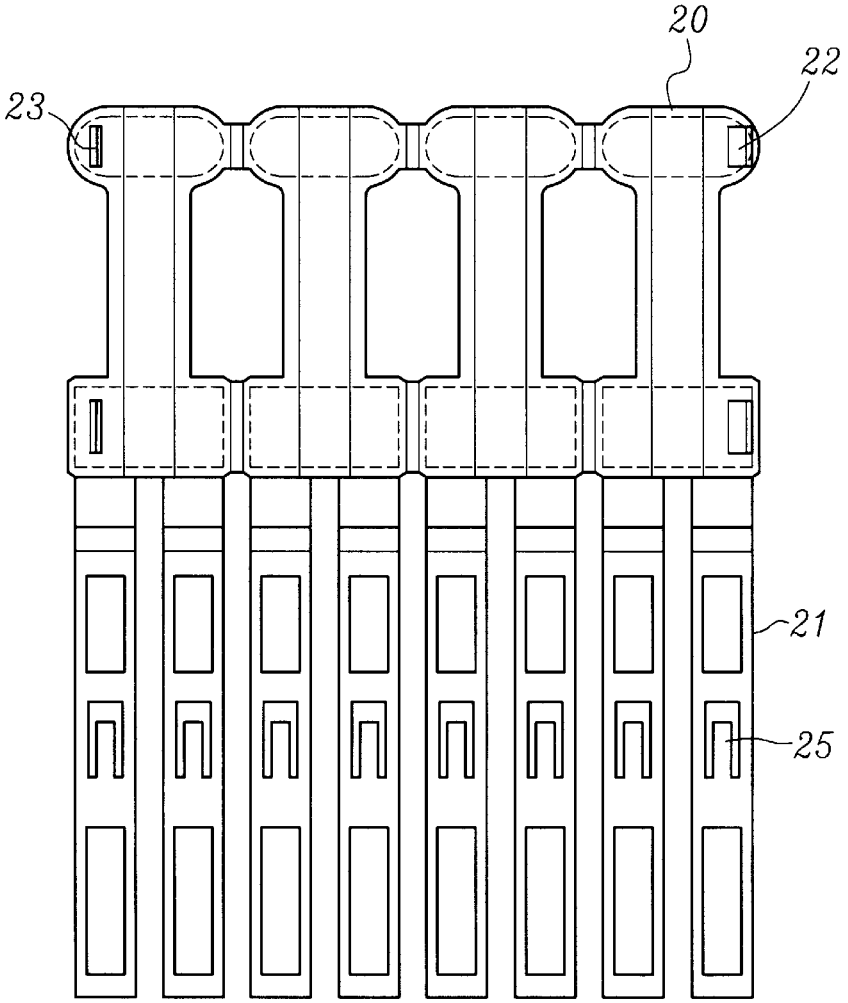
FIG. 11 is a front view of an umbrella according to the fourth preferred embodiment of the invention.
Figure 14:
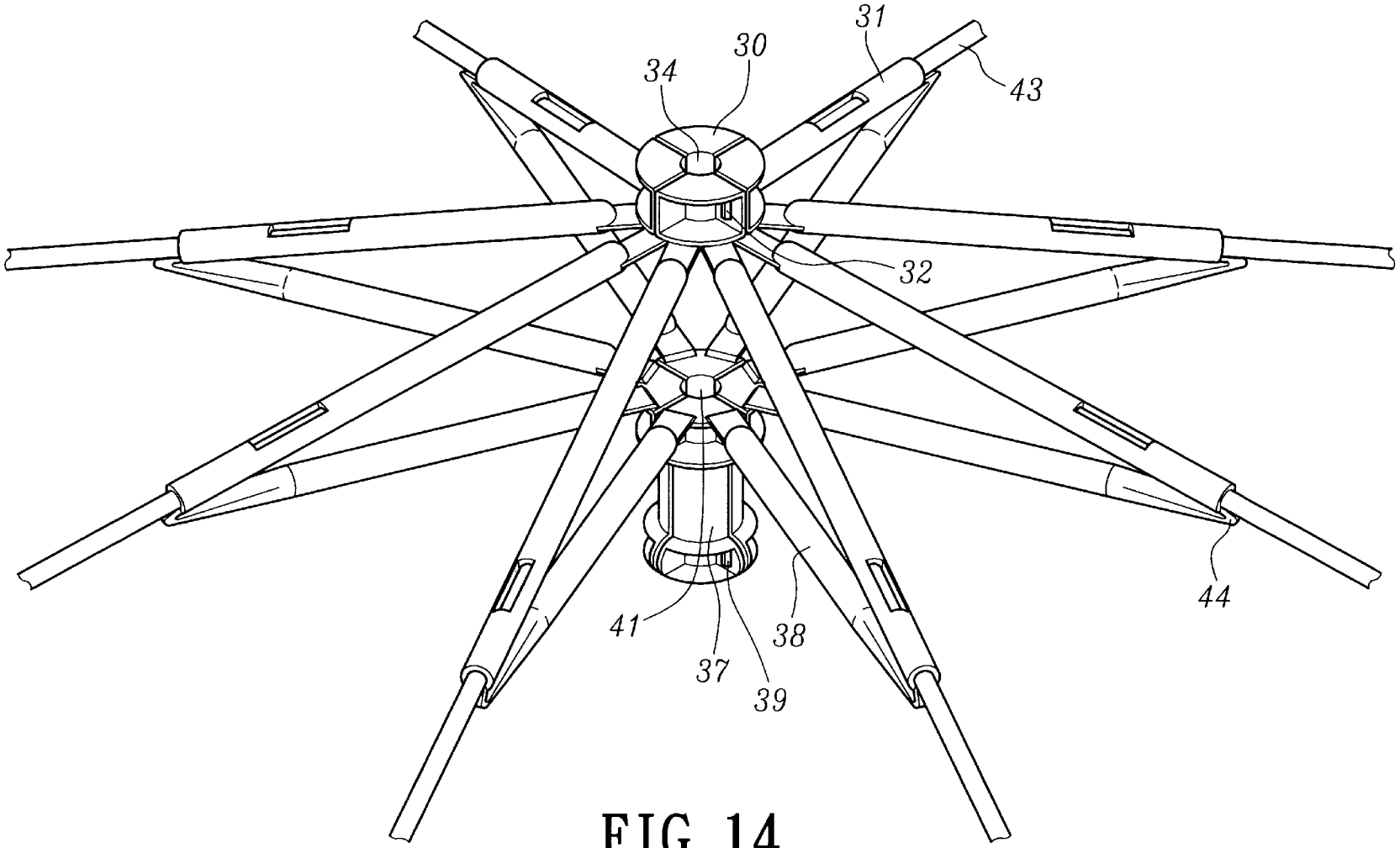
FIG. 14 is a perspective view of an umbrella according to a fifth preferred embodiment of the invention.
Figure 17:
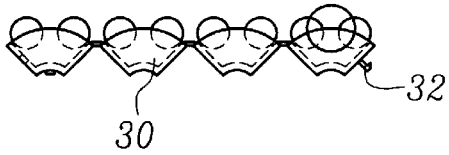
FIG. 17 is a top view of an umbrella according to the fifth preferred embodiment of the invention; and, FIG. 18 is a perspective view of an umbrella according to a sixth preferred embodiment of the invention.
Figure 16:
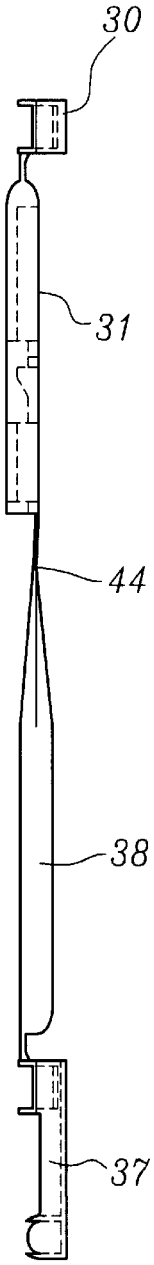
FIG. 16 is a side view of an umbrella according to the fifth preferred embodiment of the invention.
Figure 15:
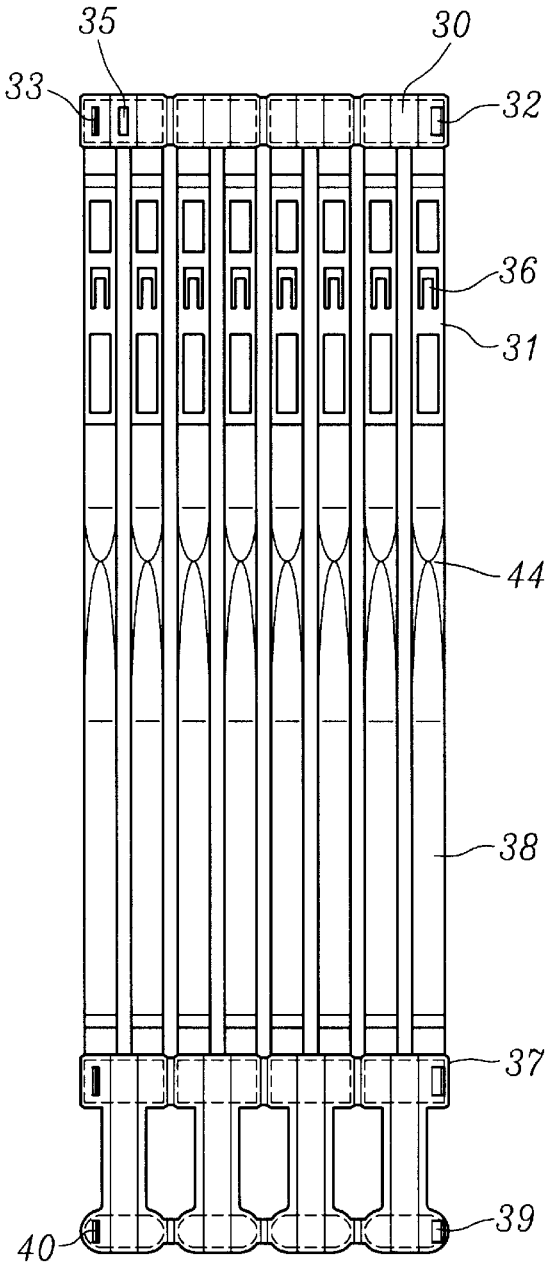
FIG. 15 is a front view of an umbrella according to the fifth preferred embodiment of the invention.

As shown in FIGS. 3 and 4, the present invention provides a hub and rib assembly for an umbrella, by which cost is reduced and safety is enhanced. The hub and rib assembly is made of an environment-friendly plastic material such as decomposable, non-toxic and ductile plastic material. The preferred embodiment is exemplified by a fixed upper hub and upper rib assembly. The hub and rib assembly comprises a hub 10 and a plurality of ribs 11. The hub 10 is of a cylindrical shape and has an assembling hole 12 at the center thereof such that the hub 10 is mounted on top of a shank 13 of an umbrella. At least one pin 14 is provided and passed through the hub 10 and the shank 13 to retain the hub 10 on the shank 13. The ribs 11 are integrally connected to the hub 10 on one end thereof and arranged in radial fashion. The hub 10 and the ribs 11 are made of ductile material, and the ribs 11 are pivotally connected to the hub 10 on one end thereof. Therefore, the ribs 11 can be expanded and shrunk with respect to the hub 10. The ribs 11 can be hollow or solid. Moreover, the ribs 11 can be of relatively long length to form a complete umbrella rib (as shown in FIG. 5) or of relatively short length and assembled with a shaft 15 to form a complete umbrella rib (as shown in FIG. 4). In the latter case, the rib 11 has an elastic hook 16, and one end of the shaft 15 has a hollow portion. When one end of the shaft 15 is inserted into the rib 11, the elastic hook 16 is locked to the hollow portion of the shaft 15 to retain the shaft 15, as shown in FIG. 4A. Moreover, the preferred embodiment can also be used in an umbrella having a fixed lower hub and lower rib assembly. In the case shown, the lower hub 10 is not fixed to the shank 13 but slidable along that shank 13. The lower hub 10 is moved upward and downward to expand or shrink the lower ribs 11.

As shown in FIGS. 6, 7, 8 and 9, the preferred embodiment is exemplified by expandable upper hub and upper rib assembly. The hub and rib assembly comprises a hub 10 and a plurality of ribs 11. The hub 10 can be expanded to a strip shape with a locking hook 17 and a locking loop 18 on two opposite sides thereof. The hub 10 can be rolled to cylindrical shape and connected by the hook 17 and the loop 18. The hub 10 has an assembling hole 12 at the center thereof such that the hub 10 is mounted on top of a shank 13 of the umbrella. At least one pin 19 is provided and passed through the hub 10 and the shank 13 to retain the hub 10 on the shank 13. The ribs 11 are integrally connected to the hub 10 on one end thereof and arranged in radial fashion. The hub 10 and the ribs 11 are made of ductile material and the ribs 11 are pivotally connected to the hub 10 on one end thereof. Therefore, the ribs 11 can be expanded and shrunk with respect to the hub 10. The ribs 11 can be hollow or solid. Moreover, the ribs 11 can be relatively long length to form a complete umbrella rib or relatively short length and assembled with a shaft 15 to form a complete umbrella rib. In later case, the rib 11 has elastic hook 16 to retain the shaft 15.

As shown in FIGS. 14, 15, 16 and 17, the preferred embodiment is exemplified by an assembly including an expandable upper hub, a lower hub, a plurality of upper ribs, and a plurality of lower ribs. The hub and rib assembly comprises a first hub 30, a plurality of ribs 31, a second hub 37, and a plurality of second ribs 38. The first hub 30 can be expanded to a strip shape with a first locking hook 32 and a first locking loop 33 on two opposite sides thereof. The hub 30 can be rolled to cylindrical shape and connected by the hook 32 and the loop 33. The hub 30 has an assembling hole 34 at the center thereof such that the hub 30 is mounted on top of a shank of the given umbrella. At least one pin 35 is provided and passed through the hub 30 and the shank to retain the hub 30 on the shank. The first ribs 31 are integrally connected to the first hub 30 on one end thereof and arranged in radial fashion. The first hub 30 and the first ribs 31 are made of ductile material, and the first ribs 31 are pivotally connected to the first hub 30 on one end thereof. Therefore, the first ribs 31 can be expanded and shrunk with respect to the first hub 30. The first ribs 31 can each be provided with a shaft 43 to increase the length of the resulting rib. The first rib 31 then has an elastic hook 36 to retain the shaft 43.

The second hub 37 can be expanded to a strip shape with a second locking hook 39 and a second locking loop 40 on two opposite sides thereof The second hub 37 can be rolled to cylindrical shape and connected by the second hook 39 and the second loop 40. The second hub 37 has an assembling hole 41 at the center thereof such that the second hub 37 is mounted on top of a shank of the umbrella. The second ribs 38 are integrally connected to the second hub 37 on one end thereof and arranged in radial fashion. The second ribs 38 can be hollow or solid. A connection part 44 is integrally connected to the lower end of the first rib 31 and the upper end of the second rib 38. Therefore, the first hub 30, the second hub 37, the first ribs 31 and the second ribs 38 are integrally connected.

The hub and rib assembly for umbrella of the present invention is characterized in that the ribs and hub are integrally formed by ductile materials. The assembling thereof is easy and not involved other tools. The cost is reduced and the safety is enhanced.

Figure 18:
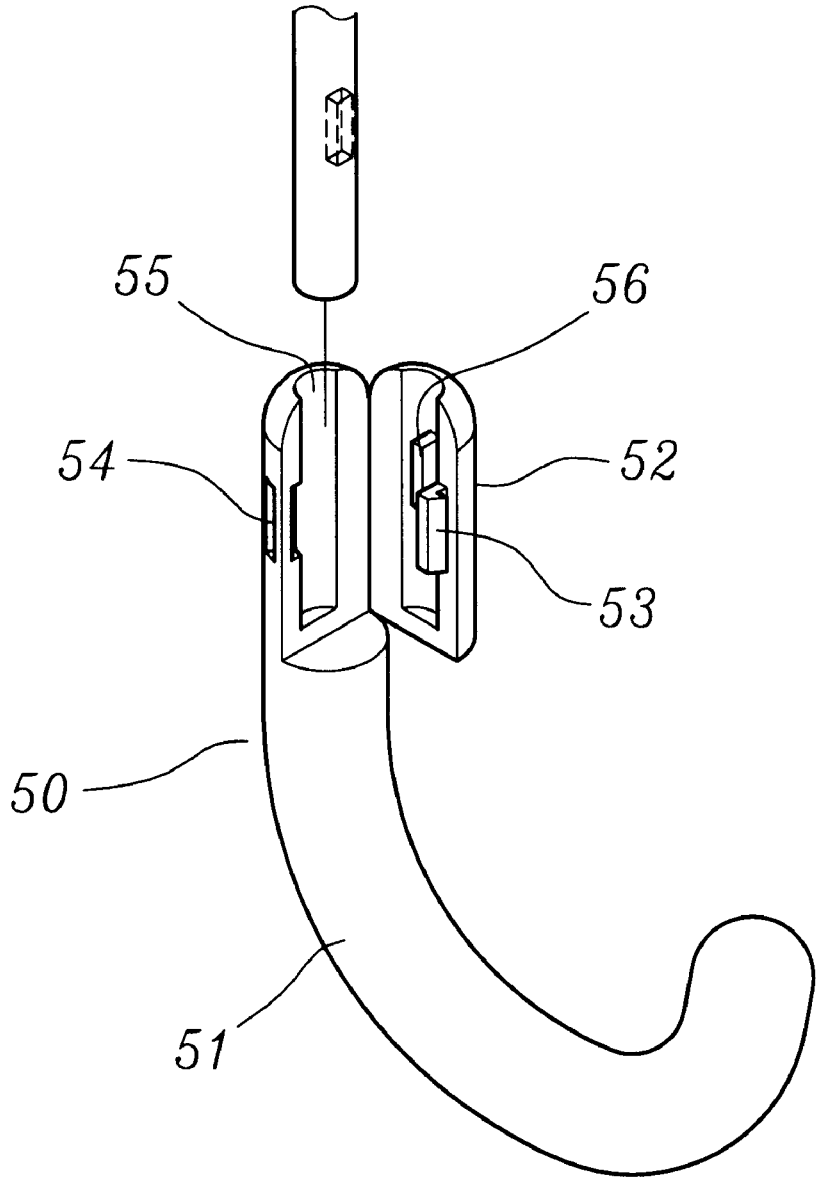

FIG. 18 shows another preferred embodiment of the present invention. A handle 50 is assembled to bottom of the shank 13. The handle 50 comprises a main body 51 and a movable part 52 formed integrally by ductile materials. The movable part 52 is pivotally connected to the main body 51. Moreover, the main body 51 and the movable part 52 are provided with a hook 53 and a loop 54 such that the main body 51 and the movable part 52 can be rolled to cylindrical shape by connecting the hook 53 and the loop 54. An assembling hole 55 is formed at the center of the main body 51 and the movable part 52 such that the main body 51 and the movable part 52 are mounted on the lower end of the shank 13. At least one pin 56 is provided and passed through the shank to retain the main body 51 and the movable part 52 on the shank. The handle 50 can be easily assembled and disassembled to recycle, thus being more environmentally concerned.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An umbrella hub and rib assembly comprising:

at least one hub portion formed of a ductile material;

a plurality of rib portions formed of a ductile material and having an end integrally joined to said hub portion, at least a part of each said rib portion having a hollow configuration defining an inner space, each said rib portion having formed thereon an elastic hook; and, at least one shaft portion extending coaxially into said inner space of one said rib portion, said shaft portion lockingly engaging said elastic hook.

2. The umbrella hub and rib assembly as recited in claim 1 comprising a first and a second of said hub portions, each of said rib portions having integrally joined first and second sections, said first section having an end integrally joined to said first hub portion, said second section having an end integrally joined to said second hub portion.

3. The umbrella hub and rib assembly as recited in claim 2 wherein each said first rib section is formed with the hollow configuration to define said inner space, said elastic hook portion being formed on each said first rib section.

4. The umbrella hub and rib assembly as recited in claim 3 wherein each of said first and second hub portions includes a plurality of sections integrally joined in cascade, a first terminal one of said sections engaging a second terminal one of said sections in releasably locked manner, whereby said first and second hub portions are each reconfigurable between rolled and expanded configurations.

5. The umbrella hub and rib assembly as recited in claim 4 wherein said first terminal section of each said first and second hub portion has formed thereon a hook element, and said second terminal section of each said first and second hub portion has formed thereon a loop element for engaging said hook element of said first terminal section in releasably locked manner.

6. An umbrella hub and rib assembly comprising:

a hub portion formed of a ductile material, said hub portion including a plurality of sections integrally joined in cascade, a first terminal one of said sections having a hook element formed thereon, a second terminal one of said sections having a loop element formed thereon for engaging said hook element of said first terminal section in releasably locked manner, whereby said hub portion is reconfigurable between rolled and expanded configurations; and, a plurality of rib portions formed of a ductile material and having an end integrally joined to said hub portion.

7. An umbrella hub and rib assembly comprising:

at least one hub portion formed of a ductile material, said hub portion being defining an assembling hole for engaging an umbrella shank;

a plurality of rib portions formed of a ductile material and having an end integrally joined to said hub portion in angularly deflectable manner, each said rib portion being deflectable to an orientation projected radially outward from said hub portion.

8. The umbrella hub and rib assembly as recited in claim 7 wherein at least a part of each said rib portion is formed having a hollow configuration defining an inner space.

9. The umbrella hub and rib assembly as recited in claim 7 wherein each said rib portion is formed having a solid configuration.

10. The umbrella hub and rib assembly as recited in claim 7 comprising a first and a second of said hub portions, each of said rib portions having integrally joined first and second sections, said first section having an end integrally joined to said first hub portion, said second section having an end integrally joined to said second hub portion.

11. The umbrella hub and rib assembly as recited in claim 10 wherein at least a part of each said rib portion is formed having a hollow configuration defining an inner space.

12. The umbrella hub and rib assembly as recited in claim 10 wherein each said rib portion is formed having a solid configuration.

* * * * *